United States Patent [19]

Gogniat et al.

[11] 4,433,921

[45] Feb. 28, 1984

[54] WATCH CRYSTAL BONDED TO WATCH CASE WITH LOW TEMPERATURE SOLDER MATERIAL

[75] Inventors: Paul Gogniat; Eric Loth, both of Bienne, Switzerland

[73] Assignee: Montres Rado S.A., Longeau, Switzerland

[21] Appl. No.: 379,516

[22] Filed: May 18, 1982

[30] Foreign Application Priority Data

May 22, 1981 [CH] Switzerland ..... 3355/81

[51] Int. Cl.[3] ..... G04B 37/00; G04B 39/00

[52] U.S. Cl. ..... 368/294; 368/296

[58] Field of Search ..... 368/289–296, 368/287, 276; 29/177, 179

[56] References Cited

U.S. PATENT DOCUMENTS 2,597,935 5/1952 Kiehl ..... 368/294

FOREIGN PATENT DOCUMENTS 688991 10/1960 France .

56-96267 8/1981 Japan ..... 368/296

582909 7/1976 Switzerland .

*Primary Examiner*—Bernard Roskoski

*Attorney, Agent, or Firm*—Levisohn, Lerner & Berger

[57] ABSTRACT

The watchcase essentially comprises a crystal 1, or other transparent part visible from the outside of the case, assembled to the body 2 or a bezel exclusively by way of a layer 3 of low-temperature solder, in the nature of a silver or tin solder. A layer of barrier coating 5, chromium for example, serves to avoid diffusion of solder in the liquid state to the surface of the crystal. The zone of junction may be masked by a metallic coating 4, and the grip of the solder may be improved with a supplementary junction layer 6. It is thus possible to make watchcases of distinguished appearance, comprising junction areas of narrower width than those required when cement is used for the assembly.

17 Claims, 17 Drawing Figures

WATCH CRYSTAL BONDED TO WATCH CASE WITH LOW TEMPERATURE SOLDER MATERIAL

BACKGROUND AND SUMMARY OF THE INVENTION

The present invention relates to a watchcase, and is more specifically concerned with the assembly of two parts of said case, at least one of them transparent and visible from the outside of the case.

There are several methods commonly adopted to achieve such an assembly. The first is that in which the transparent part, for example the crystal, is held to another part of the case, for example the bezel or the body, by purely mechanical means exerting a geometrical locking action on the crystal (clips, tracks, rims resting on a peripheral tongue of the crystal, screws) or by friction (setting of the crystal in a recess of the case).

These methods share the disadvantages of requiring either special structures on the case, not always compatible with the current tendency towards reduction of case thickness, or operations of drilling or machining the crystal, which are especially difficult to carry out on sapphire crystals used for quality watchcases. Besides, in all these assemblies it is necessary to provide sealing means, such as O-rings, independently of the means providing mechanical retention.

It will be seen that all these considerations subject the designer of watchcases to technical constraints that greatly limit the scope in creating new styles. For example, the means described above will allow cases to be made in which the crystal completely covers the top margin of the body on all sides without being held there by clips, pins, screws or other accessories encumbering the lines of the case.

Recently, therefore, a different approach has been developed, in which the crystal is held to another part of the case by means of a layer of cement. A construction using this technique is described in Swiss Patent Application No. 622,151.

Although that method serves to avoid the above mentioned disadvantages, it introduces limitations of its own, deriving directly from the properties of the cement. Specifically, the case of the above mentioned application can be built only if the body and the crystal have similar hardnesses and coefficients of expansion (sapphire on hard alloy, plastic on plastic etc) to avoid damage to the layer of cement in the event of variations in the temperature of the case.

Besides, it is difficult to obtain cements whose properties of seal and mechanical strength will both remain stable over time. To overcome this drawback, Japanese Utility Design No. 1,243,579 proposes the use of two layers of different cements juxtaposed, one to provide strength of the assembly, and the other a tight seal.

It will also be noted that for a satisfactory assembly, it is necessary to provide a comparatively great width of the layer of cement. Since the cement is generally not transparent, or does not remain so, it must be masked by metalizing the surface of the glass in the area of contact with the cement, the not inconsiderable width of which will lend an appearance of heaviness to the case.

It has likewise previously been proposed that the crystal be assembled with the bezel or body of a watchcase by means of a low-melting-point soldering material.

Thus Swiss Pat. No. 582,909 describes constructions in which the solder is applied directly between the wall of the watchcase and the surface of the crystal. To allow the soldering material to be used with the crystal, it is specified that substances such as zinc or rare earth metals are to be incorporated with the said material. No such products have ever appeared on the market. It may be supposed that they have given rise to many difficulties as to endurance of the solder-crystal junction, which would certainly be shortened by phenomena of oxidation of the welding material. Furthermore, it is clear that the appearance of such solders, visible through the crystal, would militate against their use in quality watches.

The use of a low-temperature soldering material is likewise suggested in Belgian Pat. No. 688,991. That patent, which relates to the installation of a watch movement under vacuum, specifies that the crystal, its base having previously been electrochemically coated with platinum, gold, silver or copper, is set in a recess without undue clearance. In the back corner of this recess, a small seam of low-temperature solder is laid, to be afterwards melted. In this arrangement, it is clear that the small fillet of solder in the corner of the recess serves essentially to seal the case. The mechanical retention of the crystal is provided by the recess in which it must be fitted and by the negative pressure created inside the watchcase. Thus the patent does not suggest effecting the mechanical assembly of a crystal to a watchcase with the help of solder alone. Besides, the materials deposited on the crystal are characterized by excellent permeability to diffusion of the soldering material, and therefore thick layers of this must be provided if the solder is not to show through the crystal. Now thick electrochemical deposits on mineral glass cannot provide enough adhesion to ensure adequate anchorage of the crystal unless it is held by other means.

Hence one of the essential objects of the invention is to propose means actually permitting use of a low-temperature soldering material as the sole means of assembling the crystal with a watchcase. For this end, and in view of the esthetic as well as mechanical requirements stated above, it has been found highly desirable to provide a metallic coating of special structure on the portion of the crystal surface facing the layer of solder. In general, said coating may be defined as a combination of at least three layers, some or even all of which, incidentally, may consist of the same material.

The first layer, in contact with the surface of the crystal, serves both for proper adhesion of the coating to the crystal and for masking the soldered area. The second layer serves to arrest diffusion of soldering material towards the crystal. Lastly, the third layer, at the interface between coating and solder, on the contrary permits ready diffusion of the latter and provides a purchase for the solder on the coating. Of course, the materials of the second and third layers as well as the method of deposition are so chosen as to provide firm adhesion to the first and second levels respectively.

Thus it is seen that the resulting assembly is effected partly by interdiffusion of elements of the soldering material and the third layer of the coating, which may be excellent and depends only on the choice of these materials, and partly from adhesion of the several layers of the coating to each other, or to the surface of the crystal, and their cohesion. This adhesion may be optimized by favorable choice of the processes of deposition employed.

In particular, a coating made of a single material such as for example gold or silver, deposited on the monocrystalline sapphire by the process of ionic deposition, may for example possess very good cohesion over a great thickness. In this case, the several layers above mentioned are made up respectively by the portion of the single thickness in contact with the crystal and the soldering material and by its medial portion, sufficiently thick to arrest diffusion of the soldering material.

Another object of the invention is to propose various constructions of watchcases the building of which is made possible by this new mode of assembly.

BRIEF DESCRIPTION OF THE DRAWING

The invention may be better understood from a reading of the description to follow, presented with reference to the accompanying drawings, in which.

DETAILED DESCRIPTION

Figure 1:
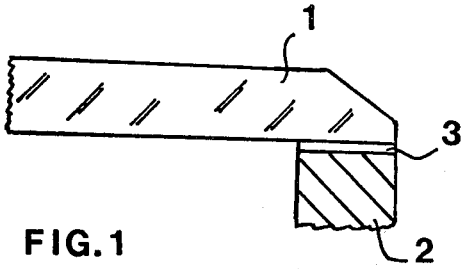
FIG. 1 is a view, in partial section, of two parts of a watchcase, assembled according to the invention.

As may best be seen in the partial view of FIG. 1, the watchcase according to the invention comprises at least two assembled parts, one of which 1 is made of a transparent material and is visible from the outside of the case. In the embodiment here shown, this is the crystal, which is mounted at the top of the body 2. The crystal 1 and body 2 are assembled by means of a layer of metallic soldering material 3. It will be understood that in the drawing, the thickness of the soldering layer and of the several layers of coating deposited on the parts to be assembled have been deliberately exaggerated for the sake of clarity.

By metallic soldering material is meant a fusible added material capable of being placed in the solid or pastry state between the facing surfaces of parts to be assembled, or being fused at a comparatively low temperature below about 600° C., compatible with the nature of the materials of the parts to be assembled, and such as to achieve a rigid assembly after cooling. Such soldering or grazing materials are known, and are based for example on a silver alloy whose melting point is near 550° C., or one of tin whose melting point is on the order of 180°-250° C.

Figure 2:
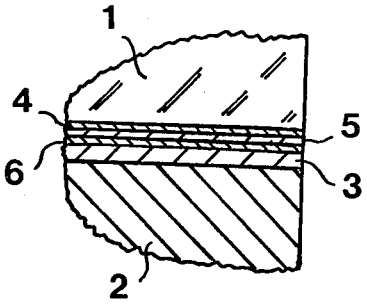
FIG. 2 is an enlarged schematic view of the region of junction of the parts in FIG. 1.

FIG. 2 schematically shows the region of junction between crystal 1 and body 2.

Prior to the soldering operation proper, the portion of the surface of the crystal 1 facing the body 2 has first been provided with a metallic coating made up of at least three superimposed layers.

The first layer consists of a masking coat 4, for example of gold, chromium or nickel, no more than a few microns or so in thickness. One of the functions of this layer is to embellish the watchcase by masking the soldered area. It must also provide a first adhesion of the coating to the crystal. This condition is met especially when it is deposited by vacuum vaporization, the monocrystalline structure of the crystal when it is of sapphire favoring its adhesion.

To keep the soldering material from diffusing in the molten state towards the crystal, the coating has a second layer consisting of a barrier 5 constituted preferably by a layer of chromium no more than a few microns in thickness, placed over the masking layer 4. This barrier layer 5 may itself constitute the masking layer provided its color suits the general appearance of the case.

A layer 6, for example of copper or gold, no more than a few microns or so in thickness, is deposited in turn on the layer 5, and forms the third layer of the coating to ensure a proper purchase for the soldering material 3.

By way of example but not of limitation, a watchcase according to the invention has been built by successive vapor depositions on the periphery of the crystal of metallic layers of gold, chromium and copper each about 0.5 microns in thickness. The thickness of the layer of solder may be about 0.1 mm.

The surface of the body 3 may likewise be coated, if necessary, with an adhesion layer, or otherwise treated to improve the bond with the layer of solder 3. Nickel-plating of this surface has been found expedient for assembling parts of hard alloy based on fritted metal carbides for example.

To perform the soldering operation, it then suffices first to arrange the soldering material in a pasty state between the facing surface of the crystal 1 and the body 3, for example by serigraphic means, or else in the solid state in the form of wire, flakes etc. In the latter alternative, it is found that upon heating, the melting solder will distribute itself uniformly by capillarity between the matching surfaces to be assembled, thus eliminating difficulties previously involved in the need for precise application of adhesive material to surfaces to be assembled by cementing.

The heating itself is done in a furnace, for example, under a controlled atmosphere. By way of indication, the thickness of the junction, after cooling of the soldering material, will generally be on the order of 0.02 to 0.15 mm.

In the next figures, some characteristic assembly structures embodying the invention have been shown.

Figure 3:
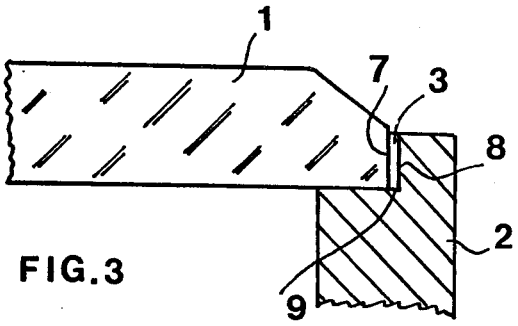
FIGS. 3 to 13 are views, similar to those of FIG. 1, of parts assembled according to eleven other modes of practicing the invention.

FIG. 3 shows for example the assembly of the crystal 1 in a recess 9 of a body or bezel 2 by soldering, the layer of soldering material 3 being arranged between a portion 7 of the rim of the crystal 1 and the lateral surface 8 of the recess. Owing to the stability of the assembly, the width of the area of contact and hence the depth of the recess may be kept to a minimum.

Figure 4:
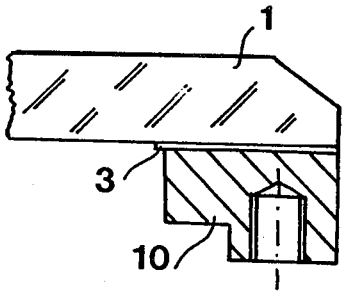
Figure 5:
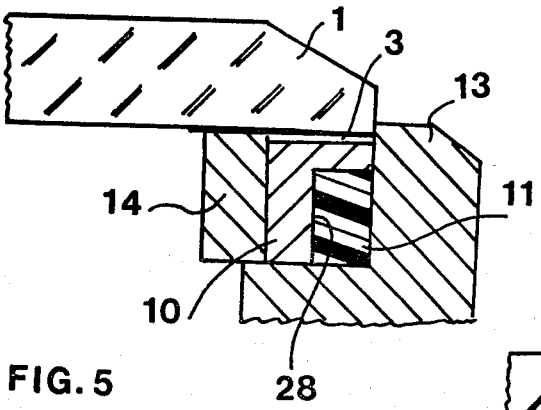

FIGS. 4 and 5 show other embodiments of the invention, in which the crystal 1 is assembled to an intermediate ring 10 capable of being attached in turn to the body of the watchcase, for example by a screw (FIG. 4) or notch (FIG. 5) connection. In the latter figure, a packing seal 11 has likewise been shown between the walls of the recess 12 in the body 13 of the case and a groove 28 in the ring 10. A tension ring 14 driven into the ring 10 serves to ensure firm retention of the ring in its recess.

Figure 6:
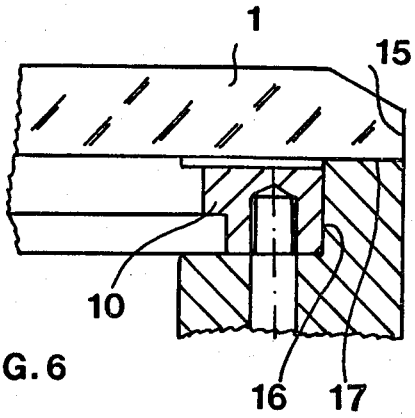
Figure 7:
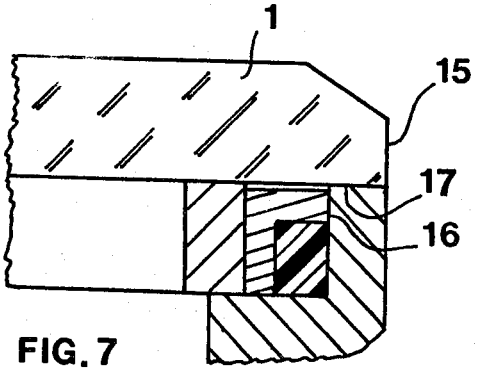

FIGS. 6 and 7 show constructions similar to those of FIGS. 4 and 5 respectively, in which, however, the outer periphery 15 of the crystal overhangs that portion 16 of the ring 10 so as to rest upon it when the ring is mounted in the body against the top margin 17 of the body, and to mask it.

Figure 8:
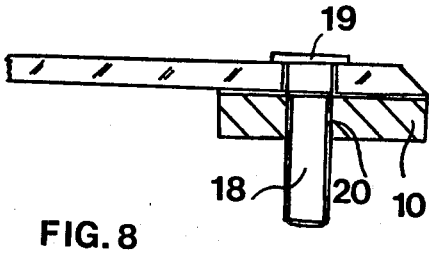
Figure 9:
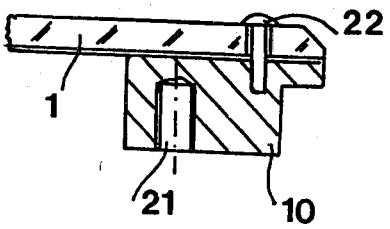
Figure 10:
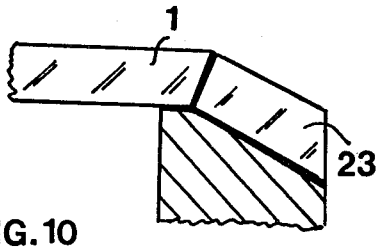
Figure 11:
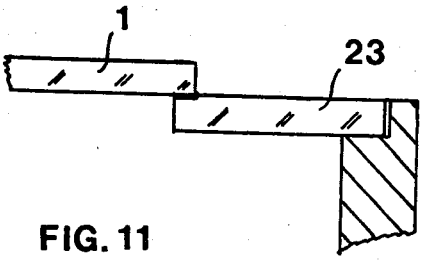
Figure 10A:
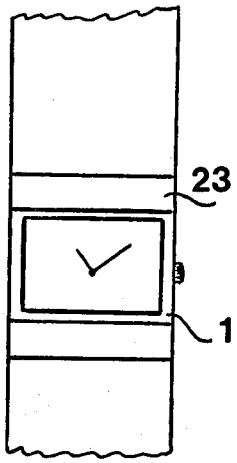
Figure 11A:
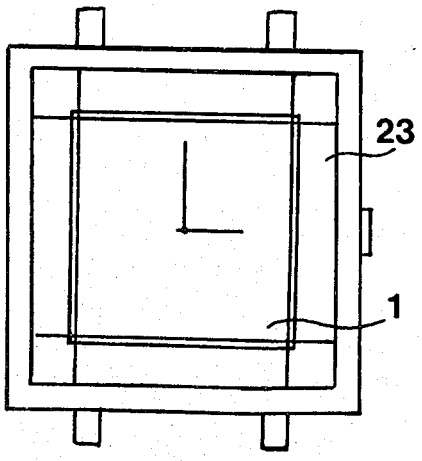
FIGS. 11*a*, 12*a* and 13*a* are respectively schematic top views of watches comprising the parts assembled in FIGS. 11, 12 and 13.
Figure 12:
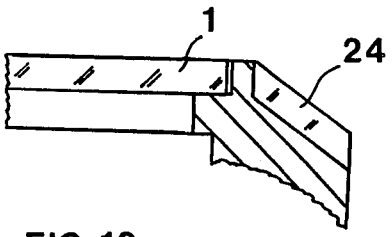
Figure 12A:
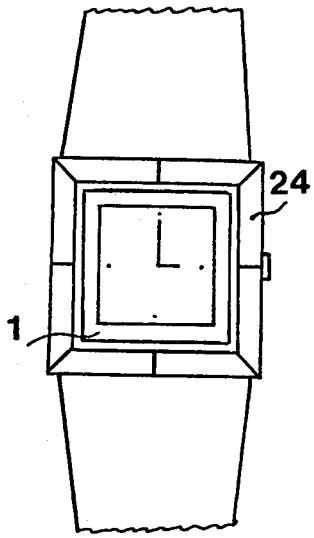

FIGS. 8 and 9 represent still other structures in which an intermediate ring 10 is assembled with a crystal 1 of very small thickness, for example between 0.5 and 1 mm. In these embodiments, the ring 10 serves to reinforce the crystal near its points of assembly with the case. In FIG. 8, this is accomplished by means of a screw 18 passing through the crystal 1 and the ring 10, its head 19 flush with the outer surface of the crystal, but its threaded shank screwed only into the thickness of the ring, to avoid any stress on the crystal. In FIG. 9, the ring is attached to the body by means of a screw engaging a threaded hole 21 in the ring 10. Thus it can be made to appear that the crystal is fastened by very small nails 22, which are simply pressed or otherwise held in the ring 10 and pass through the crystal 1.

FIGS. 10, 10*a*, 11 and 11*a* show still other embodiments by way of example, in which the crystal 1 is assembled by soldering to ornamental features 23 of hard alloy or sapphire, fixed to the case in turn by soldering or by any other means.

Figure 13:
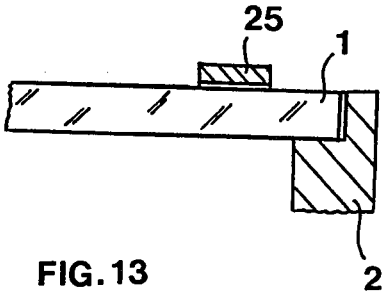
Figure 13A:
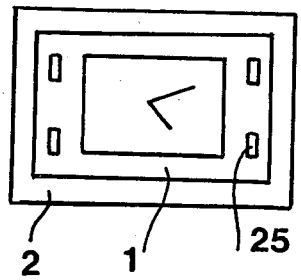

FIGS. 12, 12*a*, 13 and 13*a* show watchcase constructions in which soldered assembly is used, for purposes of decoration or protection, to attach transparent ornamental features 24 or 25 respectively to the surface of the body or bezel of the case (FIG. 12) or to the surface of the crystal (FIG. 13).

Figure 14:
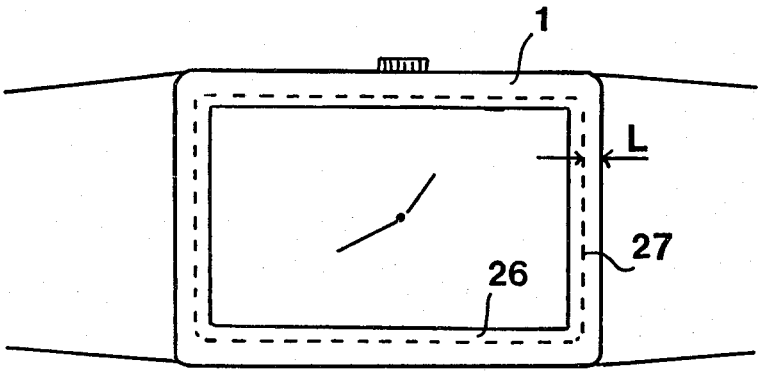
FIG. 14 is a schematic top view of a watchcase according to still another embodiment of the invention.

Lastly, FIG. 14 schematically shows a watchcase in top view, its characteristic appearance resulting from the adoption of the process of assembly by soldering. This watchcase has a crystal 1 extending all the way to the edge of the body, to which it is soldered by means of a layer of soldering material concealed by a metalized area 26. The extent of this metalized area is far less than that required to conceal the layer of cement in conventional watchcases assembled by bonding. By way of indication, the least dimension L of the layer of solder, the boundary of which is indicated by dotted lines 27, is on the order of 1.5 mm, and may be as little as 0.4 mm, in a direction parallel to the plane of the facing surfaces of the assembled parts. This is due chiefly to the excellent stability of the assembly, such that the shearing stress required for separation is on the order of 620 kg per square centimeter of section of the layer of solder measured parallel to the facing surfaces of the assembled parts.

What is claimed is:

1. A watchcase comprising a first part made of a transparent material being visible from outside of the case and a second part rigidly attached to the first, a layer of low-tmperature metal soldering material attaching said first and second parts formed between said first and second parts, characterized in that the first part of the case comprises a metal coating applied to that portion of its surface which meets the metal soldering layer, the said metal coating comprising at least three superimposed layers comprising a first layer located next to the said surface of said first part serving to bond said metal coating thereto and mask the area being soldered, a second layer superimposed on the first layer to restrain diffusion of said soldering material towards the first part and, a third layer located next to the said metallic soldering layer to give the latter a purchase on the coating.

2. A watchcase according to claim 1, wherein the second layer consists of a chromium barrier layer.

3. A watchcase according to claims 1 or 2, wherein said first, second and third layers are approximately of equal thickness.

4. A watchcase according to claims 1 or 2, wherein said first, second and third layers form a unitary material thickness.

5. A watchcase according to claims 1 or 2, wherein said first part comprises the crystal of the watch.

6. A watchcase according to claim 5, wherein the second part comprises a recess for placement of the crystal wherein the layer of soldering material is disposed between at least one portion of the rim of the crystal and the lateral surface of the recess.

7. A watchcase according to claim 5, wherein the second part comprises the body of the watch.

8. The watchcase according to claim 7, wherein the second part comprises the bezel of the watch.

9. A watchcase according to claims 5 or 7, wherein the second part comprises an intermediate ring removably attached to the body of the watch.

10. A watchcase according to claim 9, wherein the intermediate ring is engaged in a recess provided at the top of the body, wherein the outer periphery of the crystal extends beyond that of the ring so as to bear against the top margin of the body to conceal it.

11. A watchcase according to claims 5, 7 or 8, wherein the second part comprises an ornamental piece attached to the body or bezel of the case.

12. A watchcase according to claim 11, wherein said ornamental part comprises a transparent material.

13. A watchcase according to claim 12, wherein said ornamental part comprises mineral glass.

14. A watchcase according to claim 12, wherein said ornamental piece comprises a sapphire.

15. A watchcase according to claim 5, wherein the second part comprises an ornamental piece fixed to the surface of the crystal facing the outside.

16. A watchcase according to claims 1 or 2, wherein the smallest dimension of the layer of soldering material in a direction parallel to the plane of the facing surfaces of the first and second part is no greater than 1.5 mm.

17. A watchcase according to claims 1 or 2, wherein the tearing force required to separate the first and second parts is no less than 620 kg per square centimeter of section of the layer of soldering material measured parallel to the plane of the facing surfaces of the said parts.

* * * * *